US008944042B2

(12) United States Patent
Imle et al.

(10) Patent No.: US 8,944,042 B2
(45) Date of Patent: Feb. 3, 2015

(54) WALL LINING OF INDUSTRIAL OVENS

(75) Inventors: Johannes Imle, Landau (DE); Markus Horn, Oftersheim (DE)

(73) Assignee: Jünger + Gräter GmbH Feuerfestbau, Schwetzingen (DE)

( * ) Notice: Subject to any disclaimer, the term of this patent is extended or adjusted under 35 U.S.C. 154(b) by 754 days.

(21) Appl. No.: 12/819,715

(22) Filed: Jun. 21, 2010

(65) Prior Publication Data

US 2010/0252018 A1 Oct. 7, 2010

Related U.S. Application Data

(63) Continuation of application No. PCT/EP2008/009856, filed on Nov. 21, 2008.

(30) Foreign Application Priority Data

Dec. 22, 2007 (DE) ..... 10 2007 062 450

(51) Int. Cl.
*F24C 15/34* (2006.01)
*F23M 5/00* (2006.01)
*F23M 5/08* (2006.01)

(52) U.S. Cl.
CPC ..... *F23M 5/00* (2013.01); *F23M 5/085* (2013.01); *F23M 2900/05003* (2013.01); *F23M 2900/05001* (2013.01)
USPC ..... 126/19 R; 126/144; 52/98; 52/99; 52/576; 52/698; 266/280; 110/336; 110/338; 110/317; 432/238

(58) Field of Classification Search
CPC ..... F23M 2900/05001; F23M 2900/05003
USPC ..... 129/19 R; 373/167, 155, 162, 164; 432/233, 238, 251, 252
See application file for complete search history.

(56) References Cited

U.S. PATENT DOCUMENTS

| | | | | | |
|---|---|---|---|---|---|
| 814,949 | A | * | 3/1906 | Edgar | 110/336 |
| 1,634,291 | A | * | 7/1927 | Kerr | 110/286 |
| 1,786,593 | A | * | 12/1930 | Benner | 122/6 A |
| 1,992,620 | A | * | 2/1935 | Johnson | 52/479 |
| 2,223,401 | A | * | 12/1940 | Bigelow | 52/506.03 |
| 2,272,217 | A | * | 2/1942 | Longenecker | 65/335 |
| 2,310,698 | A | * | 2/1943 | Hulton | 432/4 |
| 2,641,205 | A | | 10/1947 | Dolezal | |

(Continued)

FOREIGN PATENT DOCUMENTS

| | | | |
|---|---|---|---|
| DE | 9016206 | U1 | 2/1991 |
| DE | 4305643 | C2 | 8/1993 |

(Continued)

OTHER PUBLICATIONS

Merriam-Webster online dictionary definition for "Within" http://www.merriam-webster.com/dictionary/within.*

*Primary Examiner* — Avinash Savani
*Assistant Examiner* — Martha Becton
(74) *Attorney, Agent, or Firm* — Hudak, Shunk & Farine Co. LPA

(57) ABSTRACT

A wall lining of industrial ovens for protecting from corrosion, in particular, a heat-resistant wall made of concrete, steel, sheet metal, or the like. The lining of the wall is made of at least two layers, wherein a layer is pressurized as a blocking layer.

9 Claims, 1 Drawing Sheet

(56) References Cited

U.S. PATENT DOCUMENTS

| | | | | | |
|---|---|---|---|---|---|
| 2,517,802 | A | * | 8/1950 | Rubissow | 164/17 |
| 2,641,551 | A | * | 6/1953 | Smith et al. | 106/14.34 |
| 2,665,895 | A | * | 1/1954 | Herman | 432/250 |
| 2,707,353 | A | * | 5/1955 | Honiss | 65/346 |
| 2,727,737 | A | * | 12/1955 | Dole | 266/138 |
| 3,245,674 | A | * | 4/1966 | Baer et al. | 266/275 |
| 3,315,950 | A | * | 4/1967 | Potocnik et al. | 432/238 |
| 3,336,712 | A | * | 8/1967 | Bartley | 52/378 |
| 3,489,705 | A | * | 1/1970 | Sanders et al. | 524/224 |
| 3,568,611 | A | * | 3/1971 | Konrad et al. | 110/335 |
| 4,177,036 | A | * | 12/1979 | Sauder | 432/247 |
| 4,270,348 | A | * | 6/1981 | Winberg | 60/323 |
| 4,537,671 | A | * | 8/1985 | Zollinger et al. | 204/247.5 |
| 4,642,011 | A | * | 2/1987 | Uramoto et al. | 411/258 |
| 4,705,475 | A | * | 11/1987 | Coates | 432/238 |
| 5,011,402 | A | * | 4/1991 | Hammond | 432/238 |
| 5,137,603 | A | * | 8/1992 | Arthur et al. | 202/139 |
| 5,163,831 | A | * | 11/1992 | Hammond | 432/238 |
| 5,755,216 | A | * | 5/1998 | Salyer | 126/618 |
| 5,958,814 | A | * | 9/1999 | Dinelli et al. | 501/105 |
| 6,025,438 | A | * | 2/2000 | Hinterwaldner et al. | 525/112 |
| 6,352,041 | B1 | * | 3/2002 | Lin et al. | 110/341 |
| 6,397,765 | B1 | * | 6/2002 | Becker | 110/336 |
| 6,612,248 | B2 | * | 9/2003 | Becker | 110/336 |
| 7,196,767 | B2 | * | 3/2007 | Ritzen et al. | 355/30 |
| 8,257,645 | B2 | * | 9/2012 | Lee et al. | 266/283 |
| 2001/0001365 | A1 | * | 5/2001 | Boaz | 65/258 |
| 2004/0208726 | A1 | * | 10/2004 | Bohme et al. | 411/411 |
| 2006/0263622 | A1 | * | 11/2006 | Nagasaki et al. | 428/570 |
| 2007/0277471 | A1 | * | 12/2007 | Gibson | 52/596 |
| 2009/0020927 | A1 | * | 1/2009 | Barrett et al. | 266/283 |
| 2010/0252953 | A1 | * | 10/2010 | Simmons et al. | 264/257 |
| 2013/0108886 | A1 | * | 5/2013 | Jahrling et al. | 428/601 |
| 2013/0186142 | A1 | * | 7/2013 | Nagata et al. | 65/83 |

FOREIGN PATENT DOCUMENTS

| | | | |
|---|---|---|---|
| DE | 69115145 | T2 | 10/1996 |
| DE | 19816059 | A1 | 10/1999 |
| DE | 102008014984 | B3 | 3/2008 |
| EP | 1577625 | A1 | 9/2005 |

* cited by examiner

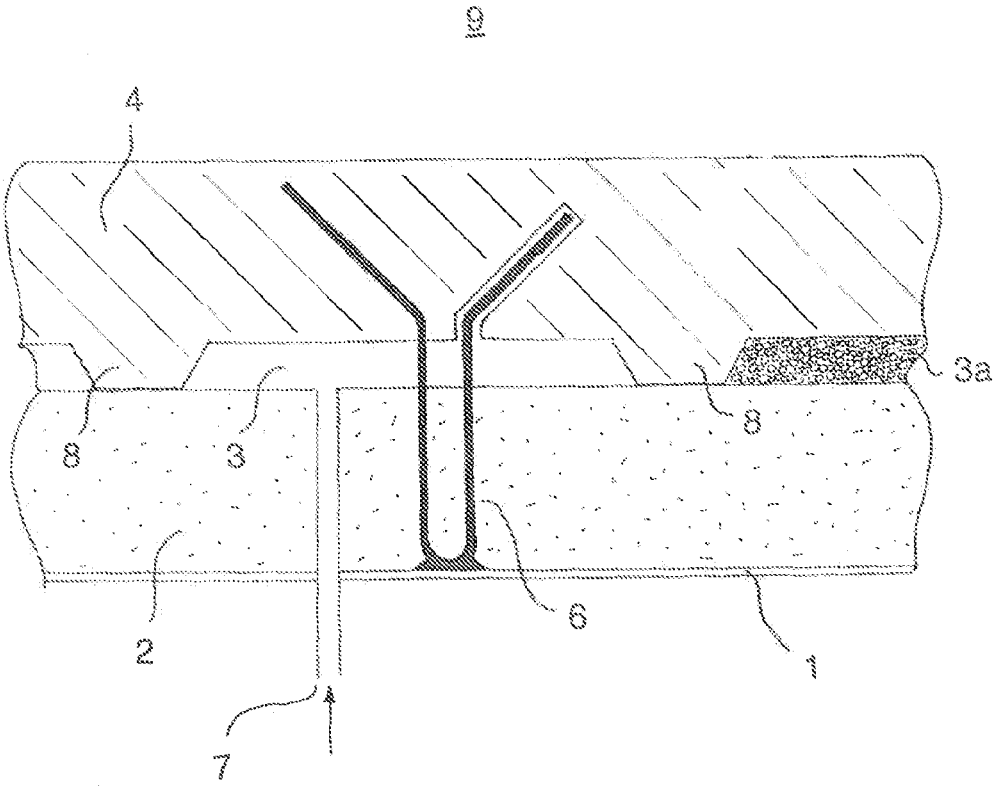
9
4
3a
8
3
8
2
6
1
7

WALL LINING OF INDUSTRIAL OVENS

CROSS-REFERENCE TO RELATED APPLICATIONS

This application claims the benefit of the priority filing date in PCT/EP2008/009856 referenced in WIPO Publication WO/2009/080167 and to German Patent Application No. 10 2007 062 450.8, filed on Dec. 22, 2007.

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

FIELD OF THE INVENTION

The invention concerns a wall lining for industrial ovens for protection of wall components from corrosion. The wall structure can be stratified of concrete, steel, sheet metal and/or similar heat resistant layers.

BACKGROUND OF THE INVENTION

In industrial applications, ovens are installed, which are enclosed within high temperature resistant materials i.e. refractories. In the operation of such ovens, interior temperatures may exceed 1000° Celsius (hereinafter "° C."). The heat-resistant walls of such ovens are exposed to the environment on the outside and exhibit a surface temperature substantially less than that of the interior. At a general room temperature of 20° C., the outer wall temperature may be, for example, 60° C., while the interior wall exposed to the operating temperature stands between 400 to 900° C. The high-temperature resistant material, i.e. refractory, of which the oven wall is composed, is thus subjected to extreme variances in temperature. Under these conditions a danger exists, that fissures can form in the wall material.

Thus a problem arises that aggressive gases arising within the oven can migrate through such fissures and attack the positioned layers and casing in the wall. The result is that a debilitating corrosion occurs.

SUMMARY OF THE INVENTION

The present invention has the purpose of protecting the wall of an oven from such destructive corrosion, wherein the wall is composed of concrete, steel, sheet metal and/or similar heat resistant materials.

This purpose is achieved, in accord with the invention, in that the construction of the wall consists of at least two layers, wherein one of the layers is a pressurized air, predetermined sized enclosure.

Especially highly recommended types of invented wall construction are described and explained in subordinate claims.

Advantageously, a mechanical binding exists between layers which successively form the wall. The most inner of the layers consists of heat-resistant material such as a high-temperature resistant material or concrete (hereinafter referred to as "refractory"), which is fastened in place by metallic anchors or similar steel fasteners. The blocking layer holding pressurized air, as described below, is found between this inner refractory and an outer steel casing. The invented, pressurized, blocking layer can also be placed between an insulation layer and the refractory layer, whereby, fissures in the refractory material lead aggressive gas to engage the blocking pressurized layer. Unlike the aggressive gas from the oven, the pressurizing medium is inert and is normally air. The feeding of this pressurizing air is accomplished with known means, while the pressure and flow thereof are controlled by standard methods.

Advantageously, the pressurized air layer can be filled with a porous material. That is to say, the filling could be comprised of a ceramic fiber or a foamed substance. In this way, the achievement is gained, first, that a pressurized, air filled blocking layer is obtained, which repels the attack of corrosive gas, and second, by means of the mechanical stability of a highly porous layer, the required mechanical binding between the layers is assured.

In accordance with another especially recommended method of construction, protrusions, at predetermined intervals, extend themselves from the refractory layer to penetrate the pressurized, air filled blocking layer. These protrusions assure that a known spatial interval exists between the support points within the blocking layer, whereby, again, the required binding between the layers remains intact. Additionally, as described below, metal anchors are advantageously arranged, that the surfaces of the above-said metallic anchors subject to corrosive attack are enveloped in a flow of moving, inert air.

In the case of an additional, especially highly recommended method of construction, the metallic anchors, which serve for fastening the lining, protrude through the pressurized blocking layer. They are coated with a substance which will change its properties when subjected to operational temperatures. This change can include one or more of the following states: melting, burning, softening, shrinking, contracting, sublimation, evaporation, or slowly vaporizing.

This material accordingly disappears at operating temperatures leaving a void, so that the pressurized air can enter and envelope the anchoring. In this way, the anchors are better protected from the corrosion of aggressive oven generated gases.

In accordance with another preferred embodiment, the blocking layer has the character of at least a single enclosed chamber, filled with pressurized air. In this embodiment, a closed space exists between the described high temperature lining and the casing which can be filled with pressurized air. In the case of this arrangement, no mechanical binding between the layers is necessary.

In many industrial processes, operating ovens possess a sheet metal casing. In accordance with the invention, this casing is designed to be protected with at least one layer of refractory, whereby, between this wearing surface made of refractory and the sheet metal, at least one layer of pressurized air forming a blocking layer is present. This now blocking air layer considerably obstructs the progress of aggressive gas toward the sheet metal casing.

BRIEF DESCRIPTION OF THE DRAWINGS

FIG. 1: displays a cross section of the invented high temperature wall construction.

DETAILED DESCRIPTION OF THE INVENTION

The casing 1 is sheet metal. This casing 1 encloses three layers of the wall, namely, in order from the oven interior outward: a wearing surface 4, pressurized air-containing, blocking layer 3 and the insulating layer 2. The wearing surface 4 is composed of a high heat resistant material, i.e. refractory, which is fastened to the outer casing by metallic anchors 6. Between the wearing surface 4 and the casing 1, is a pressurized air layer forming a blocking layer 3 and an insulation layer 2. The blocking layer 3 is supplied with air by an inlet tube 7 so that chamber 3 advantageously becomes pressurized. This blocking layer 3 can remain either empty or may be filled with a highly porous material 3A. In either case, the blocking layer 3 is subjected to pressurized air. In this blocking layer 3, projections 8 are aligned, spaced at predetermined intervals. These determine the width of the open spacing between the wearing surface 4 and the insulation layer 2. The projections 8 consists of refractory and protrude from the wearing surface 4. The metallic anchor 6, with which the refractory layer 4 is fixed on the casing 1, penetrates through the blocking layer 3 as well as through the insulation layer 2. These metallic anchors 6 can be encapsulated in a selected substance, which change characteristics in the presence of operating temperature, such as: melting, burning, softening, shrinking, contracting, sublimation, evaporation, or slowly vaporizing. This temporary encapsulation material disappears at operating temperatures, leaving an empty space, so that the protective air, being pumped into the blocking layer 3 can flow about these anchors, thus protecting them from corrosion.

In the presentation of FIG. 1, the interior space 9 of the oven is located above the wearing surface 4. In this interior space 9 of the oven, the operating temperature can run as high as 1000° C. The casing 1 is exposed, on its outside to the room temperature, that is, approximately 20° C. The stated temperature differential between the inner and the outer sides of the wall is frequently the cause of fissures and deterioration in the refractory of the wearing surface 4. These fissures in the wearing surface 4 make it possible for the passage of aggressive combustion gas to migrate in an unrestrained manner out of the interior space 9 of the oven and through the wearing surface 4 and insulation layer 2, thus corrosively attacking the casing 1. By means of the pressurized gas in the blocking layer 3, a barrier is put in place to prevent the progress of aggressive gas through fissures in the refractory, i.e. the wearing surface 4 and through the insulation layer 2 to reach the casing 1.

What is claimed:

1. A wall lining for industrial ovens for the protection of an oven wall casing constructed of high temperature resistant materials, wherein the wall lining comprises at least three layers comprising a wearing surface made of a refractory material and defining an interior space of the oven and spanning the entire length of the oven wall casing, an insulation layer having a surface in direct contact with the casing and spanning the entire length of the oven wall casing, and a blocking layer that is different from the insulation layer, wherein the blocking layer serves as a blocking means comprising pressurized non-reactive gas or air; and wherein the three layers are arranged such that the pressurized non-reactive gas or air of the blocking layer fills any spaces or voids between the wearing surface and the insulation layer, and wherein the wearing surface includes projections located on a surface facing the casing that protrude into the blocking layer and abut against the insulation layer at predetermined spatial intervals to establish space between the wearing surface and insulation layer into which the pressurized non-reactive gas or air of the blocking layer may flow; and wherein metallic anchors are arranged on the casing and fasten the wearing surface to the casing such that a mechanical binding is present between the three layers of the wall lining, the metallic anchors having a terminal end located opposite an end arranged on the casing such that the terminal end terminates inside the wearing surface, the metallic anchors being at least partially encapsulated in a phase-changing coating such that when subjected to operating temperatures exhibits one or more of the following characteristics: melting, burning, softening, shrinking, contracting, sublimation, evaporation, or vaporizing such that at operating temperatures a void develops around the metallic anchors into which the pressurized non-reactive gas or air of the blocking layer may flow and protect the metallic anchors from corrosion.

2. The wall lining according to claim 1, wherein the blocking layer further includes a filling of porous material.

3. The wall lining according to claim 1, wherein the blocking layer further includes a filling of porous material.

4. The wall lining according to claim 1, wherein the blocking layer is designed as at least a single closed chamber, which is pressurized by an inert gas or air.

5. The wall lining according to claim 1, wherein the wall possesses a sheet metal casing, which is provided with an inner structure, comprising the wearing surface comprising the refractory material and between the wearing surface of the refractory material and the sheet metal casing is at least one layer of pressurized air forming the blocking layer.

6. A wall lining for industrial ovens for the protection of an oven wall casing constructed of high temperature resistant materials, wherein the wall lining comprises at least three layers comprising a wearing surface made of a refractory material and defining an interior space of the oven and spanning the entire length of the oven wall casing, an insulation layer comprising solid insulation and spanning the entire length of the oven wall casing, and a blocking layer that serves as a blocking means comprising pressurized non-reactive gas or air; and wherein the three layers are arranged such that the pressurized non-reactive gas or air of the blocking layer fills any spaces or voids between the wearing surface and the insulation layer; and wherein metallic anchors are arranged on the casing that fasten the wearing surface to the casing such that a mechanical binding is present between the three layers of the wall lining, the metallic anchors having a terminal end located opposite an end arranged on the casing such that terminal end terminates inside the wearing surface, the metallic anchors being at least partially encapsulated in a phase-changing coating such that when subjected to operating temperatures exhibits one or more of the following characteristics: melting, burning, softening, shrinking, contracting, sublimation, evaporation, or vaporizing such that at operating temperatures a void develops around the metallic anchors into which the pressurized non-reactive gas or air of the blocking layer may flow and protect the metallic anchors from corrosion.

7. The wall lining according to claim 6, wherein the wearing surface includes projections located on a surface facing the casing that protrude into the blocking layer, at predetermined spatial intervals to establish a distance between the wearing surface and insulation layer.

8. A wall lining for industrial ovens for the protection of an oven wall casing constructed of high temperature resistant materials, wherein the wall lining comprises at least three layers comprising a wearing surface made of a refractory material and defining an interior space of the oven and spanning the entire length of the oven wall casing, an insulation layer distinct from a blocking layer and having an inner surface in contact with the blocking layer and an outer surface in contact with the casing and spanning the entire length of the oven wall casing, and wherein the blocking layer serves as a blocking means comprising pressurized non-reactive gas or air; and wherein the three layers are arranged such that the pressurized non-reactive gas or air of the blocking layer fills any spaces or voids between the wearing surface and the insulation layer; and wherein metallic anchors are arranged on the casing that fasten the wearing surface to the casing such that a mechanical binding is present between the three layers of the wall lining, the metallic anchors having a terminal end located opposite an end arranged on the casing such that terminal end terminates inside the wearing surface, the metallic anchors being at least partially encapsulated in a phase-changing coating such that when subjected to operating temperatures exhibits one or more of the following characteristics: melting, burning, softening, shrinking, contracting, sublimation, evaporation, or vaporizing such that at operating temperatures a void develops around the metallic anchors into which the pressurized non-reactive gas or air of the blocking layer may flow and protect the metallic anchors from corrosion.

9. The wall lining according to claim 8, wherein the wearing surface includes projections located on a surface facing the casing that protrude into the blocking layer, at predetermined spatial intervals to establish a distance between the wearing surface and insulation layer.

* * * * *